United States Patent [19]

van Bogaert et al.

[11] Patent Number: 4,759,392

[45] Date of Patent: Jul. 26, 1988

[54] METHOD AND APPARATUS FOR THE CONTROL OF AUXILIARY NOZZLES FOR INSERTING WEFT THREADS IN WEAVING LOOMS

[75] Inventors: Philippe van Bogaert, Schaerbeek; Dirk Maes, Zonnebeke, both of Belgium

[73] Assignee: Picanol N.V., Belgium

[21] Appl. No.: 26,688

[22] Filed: Mar. 17, 1987

[30] Foreign Application Priority Data

Mar. 20, 1986 [NL] Netherlands ..... 8600713

[51] Int. Cl.[4] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 4,369,817 | 1/1983 | Mizuno | 139/435 |
| 4,433,705 | 2/1984 | Cech et al. | 139/435 |
| 4,532,964 | 8/1985 | Lerch | 139/435 |

FOREIGN PATENT DOCUMENTS 1535454 8/1969 Fed. Rep. of Germany .

*Primary Examiner*—Henry S. Jaudon

*Attorney, Agent, or Firm*—Bacon & Thomas

[57] ABSTRACT

A method for the control of auxiliary nozzles or blowers for the insertion of a weft thread in air jet weaving looms wherein several auxiliary blowers and/or groups of auxiliary blowers (1–9; 45; 46; 47; 50) are distributed along the shed (10) of the weaving loom comprising controlling a first row of auxiliary blowers and/or groups of auxiliary blowers (1–6; 45; 47) in such a way that these auxiliary blowers and/or groups of auxiliary blowers (1–6; 45; 47) create a basic air stream which achieves the guiding of the weft thread along the shed (10) and the control of a second row of auxiliary blowers and/or groups of auxiliary blowers (7–9; 46; 50) in such a way that these auxiliary blowers and/or groups of auxiliary blowers 7–9; 46; 50) create an additional air stream which mainly creates a pulling force of the weft threads along the shed.

12 Claims, 5 Drawing Sheets

METHOD AND APPARATUS FOR THE CONTROL OF AUXILIARY NOZZLES FOR INSERTING WEFT THREADS IN WEAVING LOOMS

BACKGROUND OF THE INVENTION

The present invention concerns a method and apparatus for the control of auxiliary air nozzle blowers used to insert and transport weft threads in weaving looms.

For air jet weaving looms, a method is already known whereby the insertion of a weft thread is mainly achieved by means of several jet nozzles including main nozzles located at the inlet of the shed and auxiliary nozzles distributed along the shed. The use and general technical result obtained by the application of auxiliary nozzles is generally known and described in detail in the German Pat. No. 1.535.454.

A method is also generally known whereby the auxiliary nozzles can be sequentially or in other words, one after the other, controlled within relatively short time intervals. According to another still well-known method, the sequential control also includes "after blowing" with a few auxiliary nozzles in order to support the thread inserted in the shed.

According to another known method, the auxiliary nozzles are controlled by means of various methods, for instance, by modifying timing of the switching-on moments, the switching-on time intervals, the working pressure and all as a function of, for instance, the weft pattern of the measured weft speed.

It is also known that some auxiliary nozzles can be alternatively via valves having various pressures varied in accordance with the weft pattern.

It is also well known that different auxiliary nozzles can be supplied with different pressures.

In all these known methods the air stream in the shed created by high quality jets, i.e., high pressure or high velocity air flowing from the auxiliary nozzles. As, however, the guiding of the weft as well as the application of a pulling force on the weft are achieved by means of high energy air jets, the disadvantage of a huge air consumption characterizes all the aforesaid methods.

SUMMARY OF THE INVENTION

The present invention concerns a method for controlling nozzles of the type described above, and contemplates an optimum utilization of the air stream created by the auxiliary puzzles with a minimum air consumption and the inserting into the shed of the weft thread as perfectly as possible.

To this end, the present invention also comprises a method for the control of the auxiliary nozzles for the insertion of a weft thread wherein several auxiliary nozzles are distributed in the shed of the weaving loom, characterized by the fact that it involves the control of a first row of auxiliary nozzles in such a way that these auxiliary nozzles create a basic or first air stream which achieves the guiding of the weft threads in the shed and the control of a second row of auxiliary nozzles in such a way that these latter auxiliary nozzles create an additional or second air stream which achieves the pulling force on the weft threads along the shed.

A regulation is preferably foreseen as a function of the weaving pattern or as a function of measurements carried out on the weft thread, whereby this regulation is preferably applied to the second row of auxiliary nozzles because this now has the strongest influence on the pulling force applied to the weft threads.

BRIEF DESCRIPTION OF THE DRAWINGS

In order that the characteristics of this invention will be better understood, a few preferred embodiments will be described hereafter without any limitative character and with reference to the figures of the drawings in which:

FIGS. 12 and 13 illustrate an alternative solution for the distribution of the auxiliary nozzles.

DETAILED DESCRIPTION OF THE PREFERRED EMBODIMENT

Figure 1:
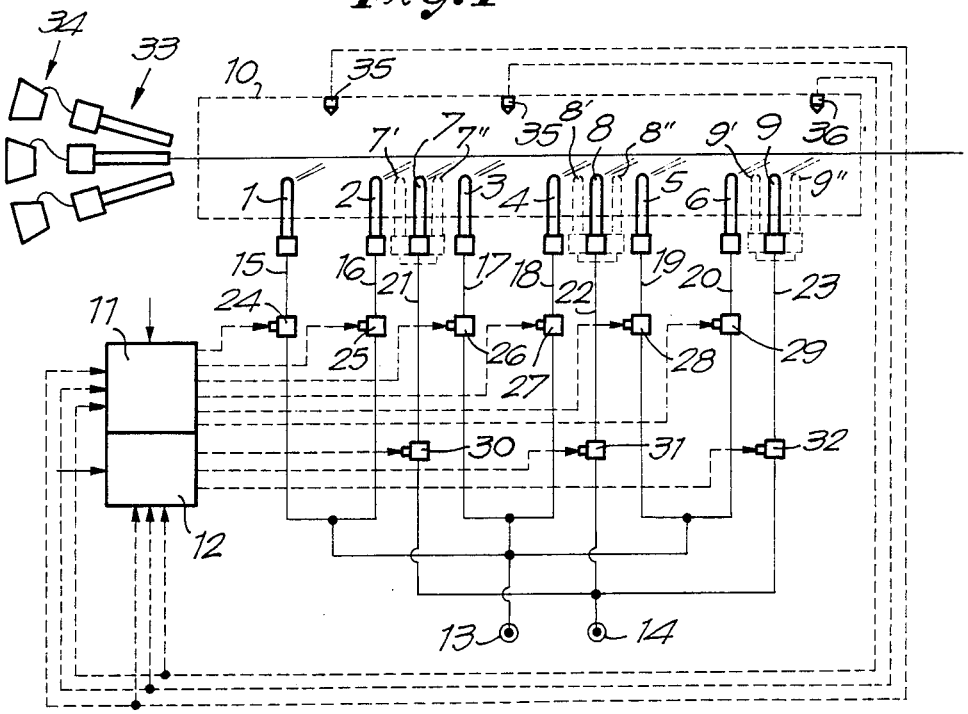
FIG. 1 is a schematic view of a device for the control of the auxiliary nozzles according to the invention.

FIG. 1 illustrates in a schematic way a device for putting into practice the method for the control of the auxiliary nozzles in accordance with the invention. The device comprises in this case several auxiliary nozzles 1 to 9 which are distributed over a loom shed schematically represented at 10, whereby a first group of these auxiliary nozzles, namely auxiliary nozzles 1 to 6, are controlled by a first control unit 11, while a second group of auxiliary nozzles, namely the auxiliary nozzles 7, 8 and 9, are controlled by a second control unit 12. The control units 11 and 12 can achieve the control of the auxiliary nozzles 1 to 9 by any known method. In accordance with the embodiment of FIG. 1 this result is achieved by, on the one hand, the connection of the separate groups of auxiliary nozzles on different compressed air lines 13 and 14, and on the other hand, the individual supply lines 15 to 23 wherein valves 24 to 32 are located and connected by means of control lines to the control units 11 and 12. Moreover the diagram of FIG. 1 also illustrates several main weft insertion nozzles 33, and weft thread supply elements 34, weft detectors 35 distributed in the shed and the weft controller 36.

The specific character of the invention is the creation of a basic air stream through the shed 10 by means of the first group of auxiliary nozzles constituted of auxiliary nozzles 1 to 6 while an additional air stream is achieved by means of the second group of auxiliary nozzles, namely the auxiliary nozzles 7 to 9.

The first control unit 11 preferably performs its regulation in such a way that the air streams created by the auxiliary nozzles 1 to 6 have a flow velocity which are actually approximately equal to the desired thread speed. The control by means of the control unit 11 is thus preferably achieved as a function of the desired weaving speed which is determined by the rotation speed of the weaving loom. Preferably this regulation is independent of the weaving pattern but can be possibly also dependent upon the measured thread speed.

The second control unit 12 achieves control of the weft threads during their insertion. The control is carried out preferably as a function of the measured thread speed and as a function of parameters which determine the force transmitted by the jet medium to the weft thread, like the kind of thread, the thread thickness, the thread temperature, the thread moisture and other thread characteristicsof this type. The adjustment as a function of the kind of weft thread is achieved also in accordance with the weaving pattern.

Figure 2:
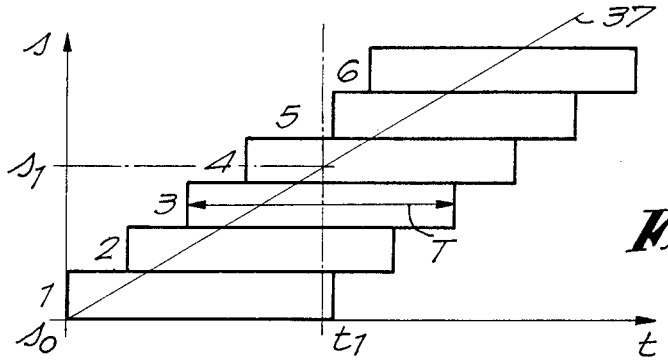
FIGS. 2 and 3 indicate the timing of switching on the auxiliary nozzles according to the invention.

FIG. 2 represents a diagram indicating one of the numerous possible schedules for timing the moments of switching-on of auxiliary nozzles 1 to 6, whereby the time t is shown on the abscissa axis while the location of the auxiliary nozzles in the shed is indicated on the ordinate axis. Line 37 indicates here the condition existing at the end of the weft thread during weft insertion into the shed 10.

Figure 3:
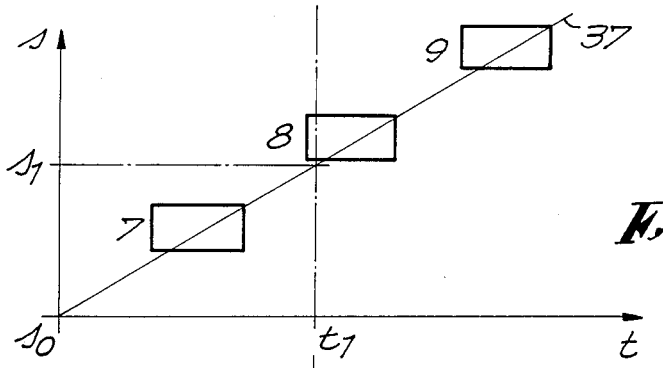

FIG. 3 is a similar diagram for the auxiliary nozzles 7 to 9.

The aforesaid air stream of the auxiliary nozzles 1 to 6 is achieved by means of various systems in accordance with the embodiment of FIG. 1. First of all, the auxiliary nozzles 1 to 6 are regularly distributed over the shed. Secondly, moderate flow velocities at the outlet openings of these auxiliary nozzles are used, for instance, by selecting a moderate air pressure at the compressed air connection 13. Thirdly relatively long switching-on times t are used, as indicated by FIG. 2. Consequently, the effective average flow velocity in relationship with the weft thread speed, in other words the average difference between the flow velocity and the weft thread speed, is limited so that the resultant air stream created by nozzles 1 to 6 has a velocity closely approximating the desired weft insertion speed. The auxiliary nozzles 7 to 9, on the other hand, as illustrated in the diagram of FIG. 3, are running with only 4 switching-on times with relatively high flow velocities which are preferably achieved by means of these auxiliary nozzles. The air supply through the auxiliary nozzles 7 to 9 thus results in local velocity peaks along the shed which are substantially higher than the weft velocity, but diminish after a relatively short time. Several auxiliary nozzles of the second group may possibly function simultaneously, but the result is the same. Specifically, the localized peaks of a velocity combine with the other air stream created by nozzles 1 to 6 to create a pulling force on the weft thread across the shed.

Figure 4:
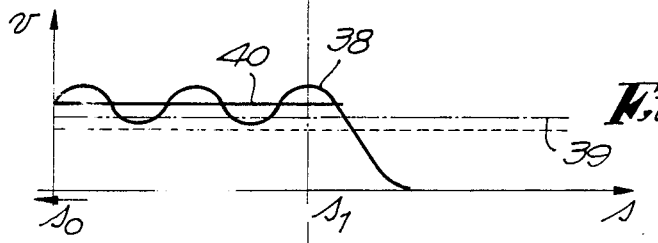
FIGS. 4 to 6 indicate, at a specific moment, the air velocities in the shed obtained respectively by a first group of auxiliary nozzles, by a second group of auxiliary nozzles, and by the combination of both.

FIG. 4 illustrates a diagram of the flow velocity for the air jet created in the shed by the nozzles 1 to 6 and such at a moment t1 and in function of the location S in the shed whereby S1 indicates the location of the thread stop at this moment t1. The curve 38 illustrates here the air stream which is created in the shed 10 and which is, properly speaking, a combination of the air stream from the main nozzle 33 and of the air stream from the auxiliary nozzle 1 to 6. Curve 39 illustrates the weft thread speed. In order to avoid deceleration of the weft thread, the curve 40 for the average air velocity must be located above the curve 39, although such is not absolutely necessary. If the average air velocity is lower than the thread speed (dotted line of FIG. 4), the weft thread is slightly decelerated during the insertion on a disadvantageous way but, however, with the advantage that the weft thread remains better in a taut condition. Moreover, it should be remarked that beyond s1 the curve 38, and consequently also the air flow velocity, declines quickly to 0 because at the moment t1 the next nozzle 5 is not yet functioning.

Figure 5:
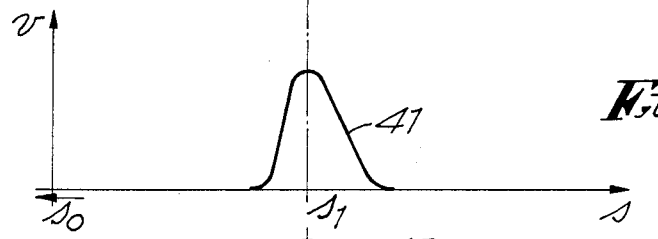

FIG. 5 gives a similar diagram for the functioning of the other nozzles 7 to 9 whereby at the moment t1, as indicated at curve 41, only auxiliary nozzle 8 is working.

Figure 6:
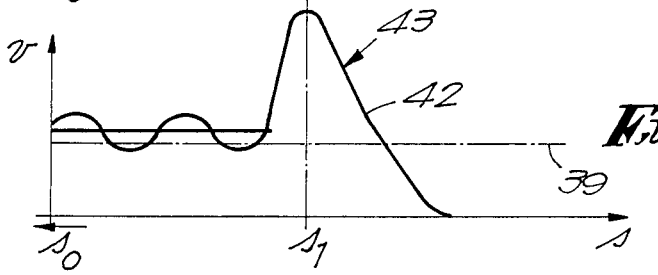
Figure 7:
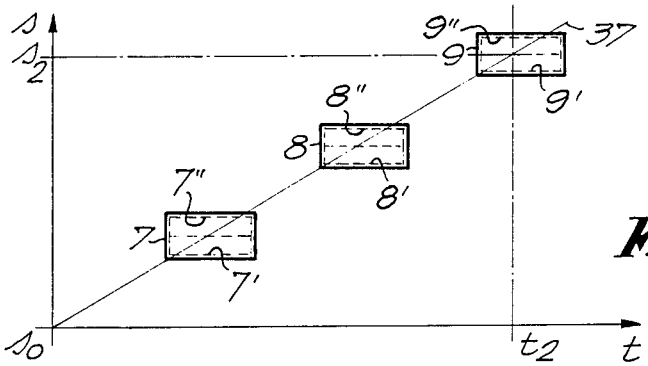
FIGS. 7 to 11 illustrate an alternative solution for achieving nozzle blowing control according to the invention wherein the various diagrams mainly correspond to these of FIGS. 2 to 6.
Figure 8:
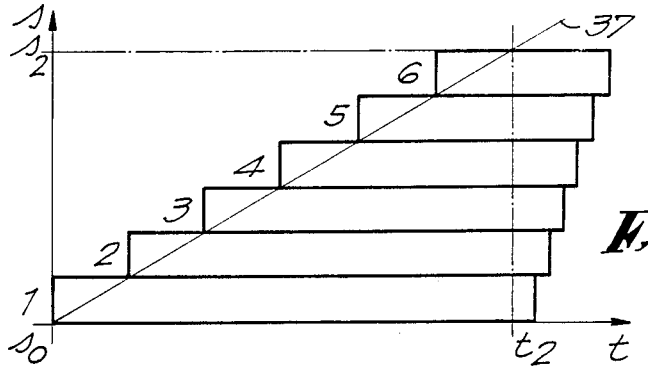

FIG. 6 illustrates by means of curve 42 the combination of the air velocities in the shed 10 at the moment t1. Quite obviously the selection of a flow peak 43 permits one to achieve an optimum pulling force effect on the weft thread. The modification of the magnitude of the flow peak 43 renders possible an easy control over thread insertion, because the force on the weft thread is determined by the speed difference between the air velocity and the thread speed.

Figure 9:
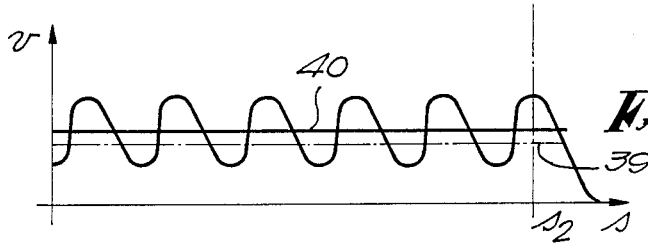
Figure 10:
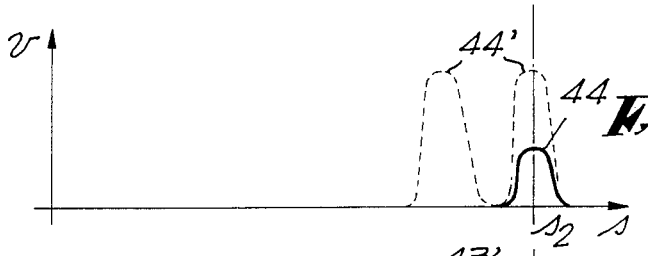
Figure 11:
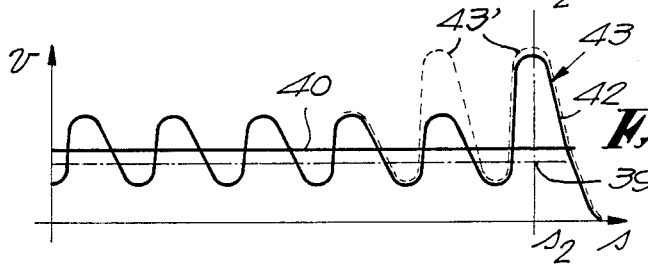

FIGS. 7 to 11 illustrate several diagrams which are similar to these in accordance with FIGS. 2 to 6. The curves of FIGS. 9 to 11 illustrate the instantaneous condition at one moment t2 where the end of the weft thread is located in s2. The difference with the former case consists, however, in the working of the auxiliary nozzles 1 to 6 with now relatively large air velocities obtained, for instance, with a larger supply pressure. Consequently relatively large velocity peaks, as indicated on FIG. 9 are occurring on each of the auxiliary nozzles 1 to 6. Preferably precautions should be taken in order that curve 40 for the average air velocity is located above curve 39 for the thread speed.

The auxiliary nozzles 7 to 9 are now creating an air stream which, as illustrated at 44 in FIG. 10, is also super-imposed on the air stream as illustrated in FIG. 9 in order to achieve the resulting flow represented by curve 42 in FIG. 1 wherein localized flow peaks 43 are created in order to achieve the desired force transmission on the weft thread during its insertion.

In a second embodiment of the invention it is possible to locate the auxiliary nozzles of the first row at larger intervals from each other because the air jets of these nozzles have a larger effective working range.

As indicated by the dotted lines of FIG. 1, and according to an alternative solution of the preferred embodiment of the auxiliary nozzles 7, 8 and 9 of the second row, these may be replaced by groups of auxiliary nozzle pairs located closely near each other as respectively indicated by 7'-7'', 8'-8'' and 9'-9''. The diagrams of FIGS. 7, 10 and 11 have thus the shape indicated by dotted lines 43' and 44'.

Figure 12:
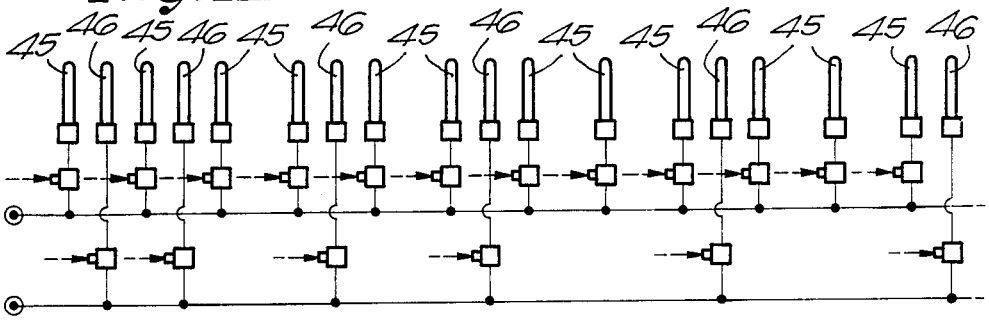

Quite obviously the auxiliary nozzles may be distributed in various ways in the shed. FIG. 12 illustrates here still another solution whereby the auxiliary nozzles 45 are distributed at equal intervals in the shed and are controlled by a first control unit while a second group of auxiliary nozzles, mainly the auxiliary nozzles 46, are more numerous in the first part of the shed than at the end of the shed and whereby these latter ones are controlled by a second control unit. This distribution is selected because in the first part of the shed the thread must be accelerated while further along the shed the thread must be only carried along.

FIG. 13 illustrates still another embodiment for the distribution of the auxiliary nozzles. The auxiliary nozzles 47 of the first row are distributed in groups whereby each group has a common valve 48. Between these groups is located an auxiliary nozzle 50 of the aforesaid second row of auxiliary nozzles which is controlled by valve 49.

Figure 15:
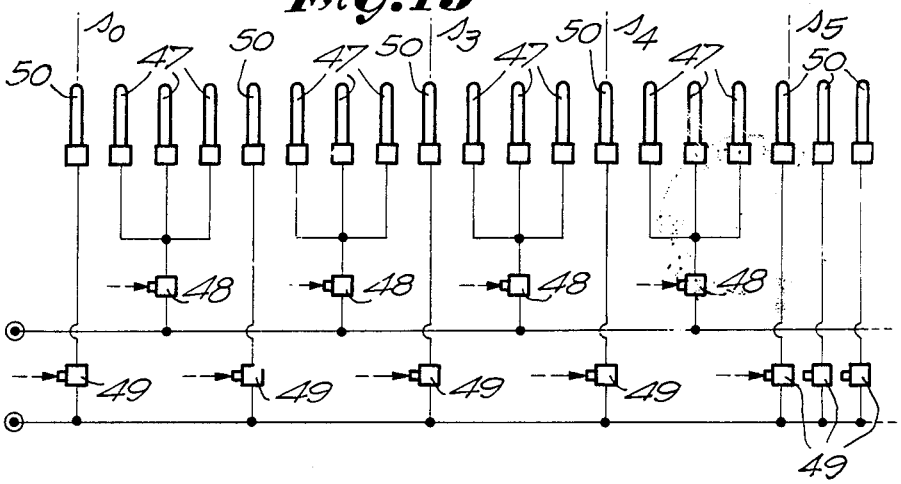
FIGS. 14 to 16 illustrate alternative solutions for the control of the auxiliary nozzles, wherein the diagrams mainly correspond to those of FIGS. 2, 3, 6 or 7, 8, 11 for a distribution of the auxiliary nozzles according to FIG. 13.
Figure 14:
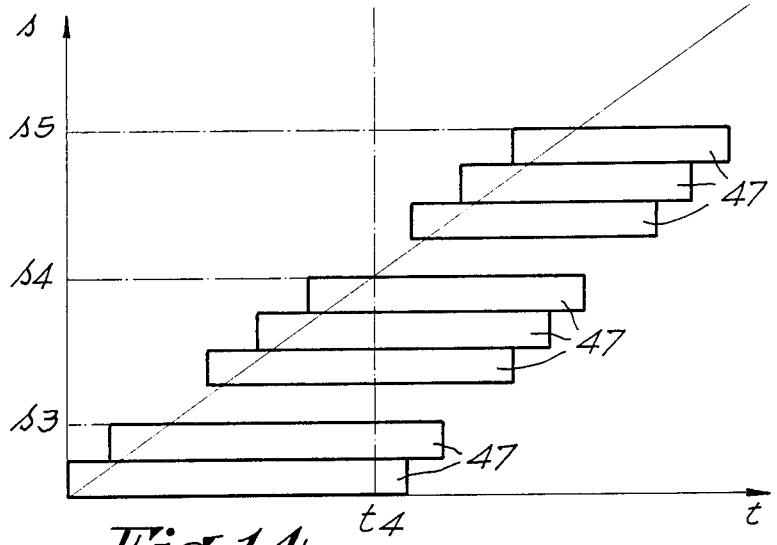
Figure 15:
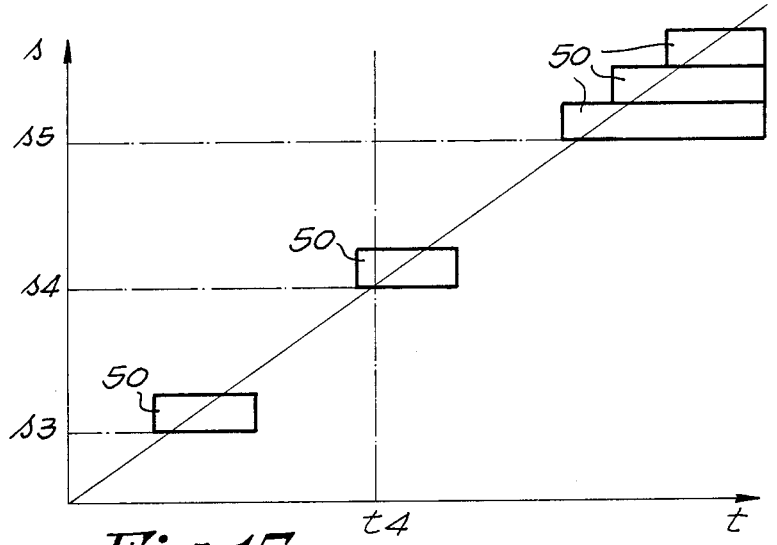

A control schedule for the first and second rows of auxiliary nozzles 47 and 50 is illustrated, respectively, in FIGS. 14 and 15.

Figure 16:
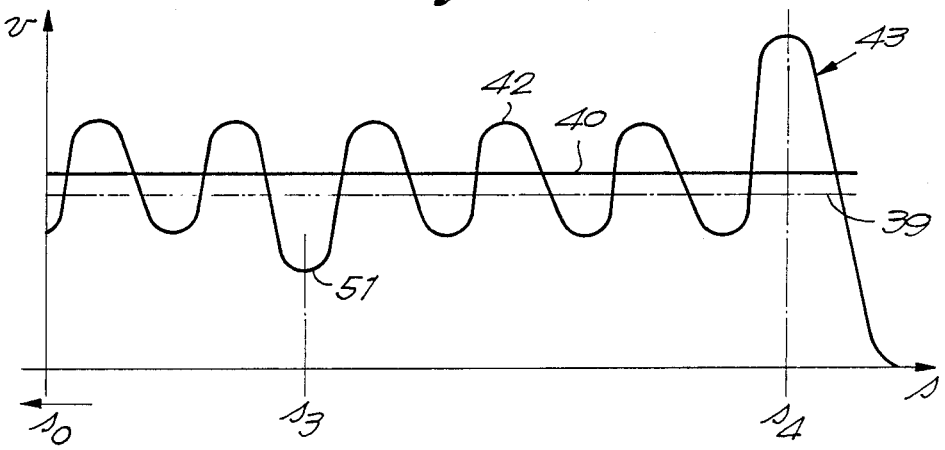

As all successive auxiliary nozzles 47 and 50 are distributed mainly at identical mutual distances, the flow velocities in the shed will have the pattern illustrated in FIG. 16, for instance, at a given moment. The curve 42 indicates here the flow velocity at the moment whereby the end of thread is located in s4 (see also FIG. 13). The auxiliary nozzle 50 at location s3 is meanwhile switched off causing a velocity reduction 51. The curve 40 of the average air velocity is preferably above the curve of the weft thread speed 39. At the end of the shed the velocity of the auxiliary nozzles 50 may be increased in order to obtain better stretching of the weft thread.

Quite obviously the control units 11 and 12 which are respectively controlling the first and the second rows of auxiliary nozzles can be controlled by the same microprocessor in a practical embodiment. All inputs on control unit 11 may also be connected to control unit 12 and vice-versa.

As each auxiliary nozzle can only be supplied from one supply line, simple 2/2 valves may be used. This is an advantageous feature because the reaction time and the pressure loss in the valves are limited.

Quite obviously the auxiliary nozzles 1–9 may have various shapes and sizes.

The present invention is by no means limited to the example described and to the embodiment illustrated by the figures, but this device as well as the method for the control of the auxiliary nozzles for the insertion of a weft thread into the shed of weaving looms can be put into practice following various embodiments without departing from the scope of this invention.

We claim:

1. A method of controlling auxiliary weft insertion nozzles disposed along a shed of an air jet weaving loom comprising:

(a) providing multiple groups of auxiliary weft insertion nozzles disposed along the shed of an air jet loom, said group including at least a first group of nozzles spaced apart along the shed and at least a second group of nozzles interspersed among the first group along the shed;

(b) supplying air to the auxiliary nozzles and controlling the timing and intensity of the discharge of air from said nozzles in such a manner that said at least first group of nozzles discharges air into the shed at a velocity and for a time period so as to create a first air stream having a first average velocity approximately corresponding with the desired weft insertion speed of a weft thread inserted into the shed by a main nozzle, said first air stream arranged to guide and support an inserted weft thread in the shed, and said at least second group of nozzles discharges air into the shed at a velocity and for a time period so as to create a second air stream having a second average velocity sufficiently higher than the desired moving speed of the inserted weft thread such that a pulling effect is obtained on the inserted weft thread by the combined first and second air streams.

2. A method of controlling auxiliary weft insertion nozzles as claimed in claim 1, wherein the average velocity of the first air stream is slightly higher than the desired weft thread speed.

3. A method of controlling auxiliary weft insertion nozzles as claimed in claim 1, wherein said second air stream is caused to flow in localized areas spaced along the shed.

4. A method of controlling auxiliary weft insertion nozzles as claimed in claim 1, wherein the average velocity of the first air stream is variable and is varied directly as a function of loom speed.

5. A method of controlling auxiliary weft insertion nozzles as claimed in claim 1, including detecting the speed of the weft thread in the shed, and wherein the average velocity of the second air stream is variable and is varied as a function of the detected speed of the weft thread.

6. A method of controlling auxiliary weft insertion nozzles as claimed in claim 1, wherein the average velocity of the second air stream is variable and is varied as a function of the transfer of air stream energy to the weft thread.

7. A method of controlling auxiliary weft insertion nozzles as claimed in claim 1, wherein the average velocity of the second air stream is variable and is varied as a function of the weaving pattern woven by the loom.

8. In an auxiliary nozzle system for an air jet weaving loom including multiple air-jet nozzles disposed along the shed of a loom and arranged to blow air from an air supply system into the shed area so as to guide and impel an inserted weft thread in and through the shed, the improvement comprising:

said multiple nozzles arranged in at least two groups, the nozzles of each group being interspersed with the nozzles of the other group along the shed;

one group of nozzles being arranged to create a first blowing action for a time period and at an intensity that essentially supports and guides an inserted weft thread across the shed, and the other group of nozzles being arranged to create a second blowing action superimposed over the first blowing action in local areas along the shed for a time period and at an intensity such that a pulling force is applied to an inserted weft thread in the direction of weft insertion across the shed by the second blowing action.

9. An auxiliary nozzle system as claimed in claim 8, including a separate control system for each group of nozzles arranged to control the timing and intensity of the blowing action of the nozzles of each group.

10. An auxiliary nozzle system as claimed in claim 8 or 9, wherein the nozzles of the other group creating the second blowing action are spaced closer together towards one end of the shed than in at least the central region of the shed.

11. An auxiliary nozzle system as claimed in claim 10, said one end being the weft stop end of the shed.

12. An auxiliary nozzle system as claimed in claim 8 or 9, wherein the first blowing action of the one group of nozzles is created by overlapped blowing times of the one group of nozzles across the shed at a blowing intensity arranged to create an average air stream flow velocity through the shed approximately corresponding to the desired weft thread insertion speed, and the second blowing action of the other group of nozzles is created by blowing times and intensities arranged to create at spaced areas along the shed localized periodic high air stream flow velocities that are substantially greater than the desired weft insertion speed so as to effect said pulling force applied to said weft thread.

* * * * *